United States Patent [19]

Maag

[11] Patent Number: 4,917,379

[45] Date of Patent: Apr. 17, 1990

[54] FOUR-BAR VARIABLE RESISTANCE ARM EXTENSION MACHINE

[76] Inventor: Henry H. Maag, 5332 Clark Cir., Westminster, Calif. 92683

[21] Appl. No.: 368,408

[22] Filed: Jun. 19, 1989

[51] Int. Cl.[4] ..... A63B 21/00

[52] U.S. Cl. ..... 272/134; 272/117

[58] Field of Search ..... 272/134, 117, 118, 901

[56] References Cited

U.S. PATENT DOCUMENTS

| | | | |
|---|---|---|---|
| Re. 31,170 | 3/1983 | Mazman | 272/118 |
| 4,563,003 | 1/1986 | Bugallo et al. | 272/134 X |
| 4,614,338 | 9/1986 | Castillo | 272/118 X |
| 4,790,530 | 12/1988 | Maag | 272/134 |

FOREIGN PATENT DOCUMENTS

| | | | |
|---|---|---|---|
| 2127309 | 4/1984 | United Kingdom | 272/134 |

*Primary Examiner*—Richard J. Apley
*Assistant Examiner*—H. Flaxman

[57] ABSTRACT

A arm extension exercise machine which utilizes a frame-journaled rotating effort arm which is mechanically linked to a frame-journaled rotating weight arm which, together with the frame of the machine and the connecting link joining them, form a simple planar double-rocking-lever four-bar linkage which acts in conjunction with the rotating weight arm to vary the resistive force applied to an operator's arm extending muscles through body-machine contact with the rotating effort arm throughout the range of the exercise movement.

3 Claims, 4 Drawing Sheets

FOUR-BAR VARIABLE RESISTANCE ARM EXTENSION MACHINE

This invention relates to exercise equipment, in particular to a arm extension exercise machine which utilizes a four-bag linkage/rotating weight arm force-varying mechanism to apply to a variably resistive force to an operator's arm extending muscles throughout the range of the arm extension exercise movement.

BACKGROUND AND OBJECTIVE OF THE INVENTION

Present day arm extension machines all work on the same primary principle of fixing the positions of the operator's upper arms while applying resistive forces to the operator's hand through circular paths about the operator's elbow joints which tend to rotate the forearms in the direction of arm flexion. The tricep muscles are developed as they oppose these forces by tending to rotate the forearms in the direction of arm extension during the exercise movement.

It is a well known fact and easily verified that due to joint mechanics, angles of pull of muscles, physiological make-up of muscles, etc. that in a arm extension movement more force can be applied through the midrange of the movement than at the start or end of the movement. Consequently, a arm extension machine which varies the resistive force applied to correspond with the positionally related strength capabilities of the operator's arm extending muscles as they extend the arms will be more effective at developing those muscles.

The standard method of varying the resistive force applied on present day arm extension machines is through the use of cams used in conjunction with chains or cables, all of which have inherent problems. The problem with cams is that they are relatively hard to manufacture. The problem with cables is that, because of their relatively small cross sectional area, they carry very high tensile stresses (a $\frac{1}{8}''$ cable carrying 200 lbs, for example, has a tensile stress in it of approximately 16,300 psi). These already high stresses are multiplied and become cyclic (introducing fatigue wear) when a cable moves along bending over a small diameter pulley. These high cyclic stresses, applied to relatively small cross sectional areas, make cables stretch (eventually decreasing the machine's intended range of motion) and eventually fray and wear out (leading to replacement or catastropic failure). Chains, while not suffering the fatigue wear that cables do, are subject to stretching at their many joints (thus decreasing the machine's intended range of motion). They, also like cables, are subject to relatively high tensile stresses and in addition are noisy and introduce spurious drag to the machine.

In view of the advantages of applying a variably resistive force to an operator's arm extending muscles in a arm extension exercise movement, and the disadvantages of obtaining such a force through the use of cams, chains, or cables, it is the objective of the disclosed invention to introduce a arm extension exercise machine which applies a variably resistive force to an operator's arm extending muscles through the use of a force-varying mechanism which uses only rigid members and pinned joints, thereby eliminating the problems associated with force-varying mechanisms using cams, chains, or cables.

SUMMARY OF THE INVENTION

The machine disclosed in this application consist of a stable frame which is provided with a pair of horizontal elbow-engaging pads for holding the operator's upper arms in the operating position while performing the exercise. Journaled in the frame, on a horizontal axis which is approximately common with the axes through the operator's elbow joints, is a rotating effort arm which includes body-machine force-transmitting contact surfaces at its distal end which engage the operator's hands and transmit resistive force from the rotating effort arm to the operator's hands through circular paths about the operator's elbow joints throughout the range of the exercise movement, as is conventional. Also journaled in the frame, on an axis which is both parallel with and offset by a specific distance from the axis of rotation of the rotating effort arm, is a rotating weight arm which contains a means for loading weights unto at a point offset from its axis of rotation (as by means of either a selectorized weight stack or a horizontal plate receiving bar). The rotating effort arm and the rotating weight arm are mechanically linked to each other at axes which are both parallel with and offset by specific distances from their respective axes of rotation by a rigid connecting link which also has a specific length between its centers of connection. These two rotating assemblies, the link joining them, and the frame of the machine join together to form a simple planar double-rocking-lever four-bar linkage which acts in conjunction with the rotating weight arm to vary the resistive force applied to the operator's hands by the rotating effort arm throughout the arm extension exercise movement. Through a simple kinematic analysis the specific lengths and orientations of the moving parts which constitute the four-bar linkage/rotating weight arm force-varying mechanism can be specified to apply a load which varies in accordance with the normal strength-to-position force-applying capabilities of the average operator in the arm extension exercise movement.

This invention, through the use of a kinematically derived and specified four-bar linkage acting in conjunction with a rotating weight arm, which together use only rigid members and pinned joints, applies a predetermined variably resistive force to an operator's arm extending muscles throughout the range of the arm extension exercise movement without the use of cams, chains, or cables, thereby fulfilling its objective.

DESCRIPTION OF THE PREFERRED EMBODIMENT

Figure 1:
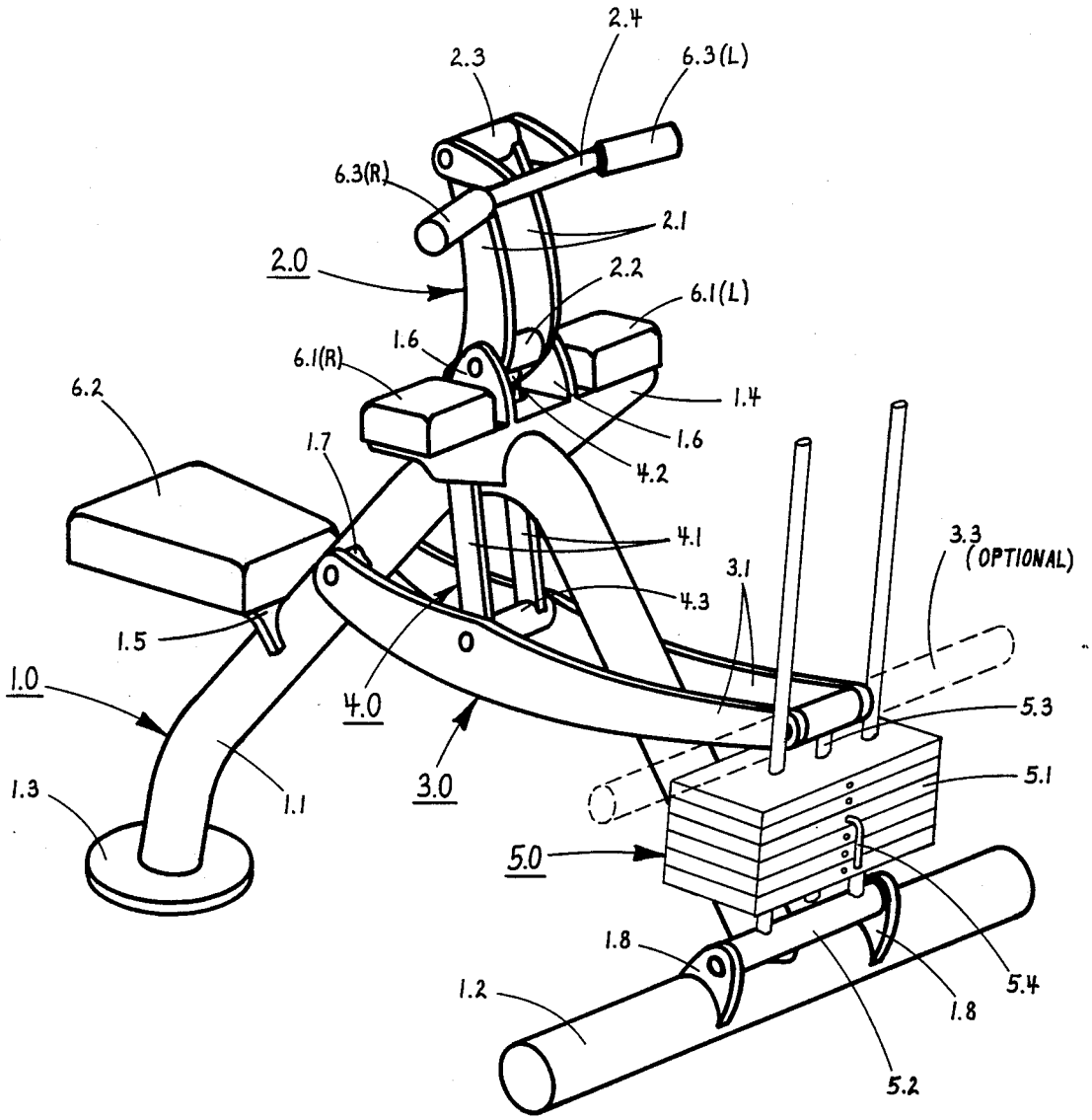
FIG. 1 is a pictorial view of the preferred configuration embodiment of the disclosed arm extension machine with all parts labeled.
Figure 2:
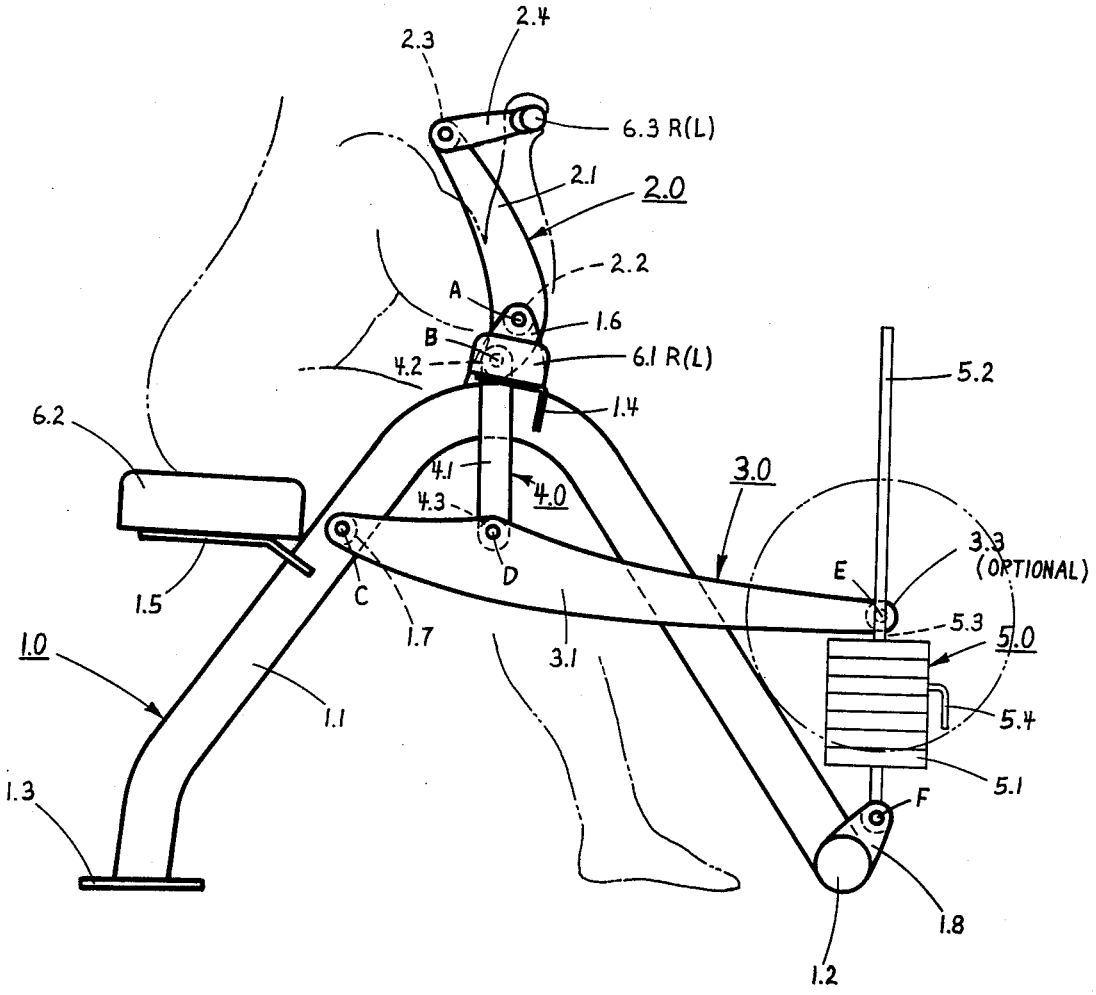
FIG. 2 is a side (plan) view of the preferred configuration embodiment of the disclosed arm extension machine with all parts labeled.

Refer now in detail to FIGS. 1 and 2 which show corresponding pictorial and side views of the preferred configuration embodiment of the disclosed invention.

In general, the frame of the machine is constructed primarily of round steel tubing which is welded together at the junctions where the tubes meet as shown. Welded to this tubular steel frame are steel flanges and steel bearing tubes for journaling the bearings for the moving parts and steel tabs for attaching padded body-machine contact surfaces. As shown in FIGS. 1 and 2, the primary frame of the invention (assembly 1.0) consist of an inverted "V" shaped bent round steel tube (part 1.1) which lies on the machine's plane of symmetry where it joins at its forward end perpendicularly into the center of a transverse straight steel tube (part 1.2) at the lower front of the machine and extends up and back down through two bends to the lower back of the machine where it joins at its rearward end into a small flat round steel plate (part 1.3) which lies on the ground plane and together with part 1.2 forms a stable base for the machine.

The operator's upper arms are constrained by a pair of horizontally mounted elbow-engaging pads (parts $\mathbf{6.1}_R$ and $\mathbf{6.1}_L$) which are mounted to part 1.1 at the top of the machine's frame by a transverse angle bracket (part 1.4) as shown. A seat support pad (part 6.2) is mounted to part 1.1 on the back side of the machine's frame by bracket 1.5 as shown.

Figure 3:
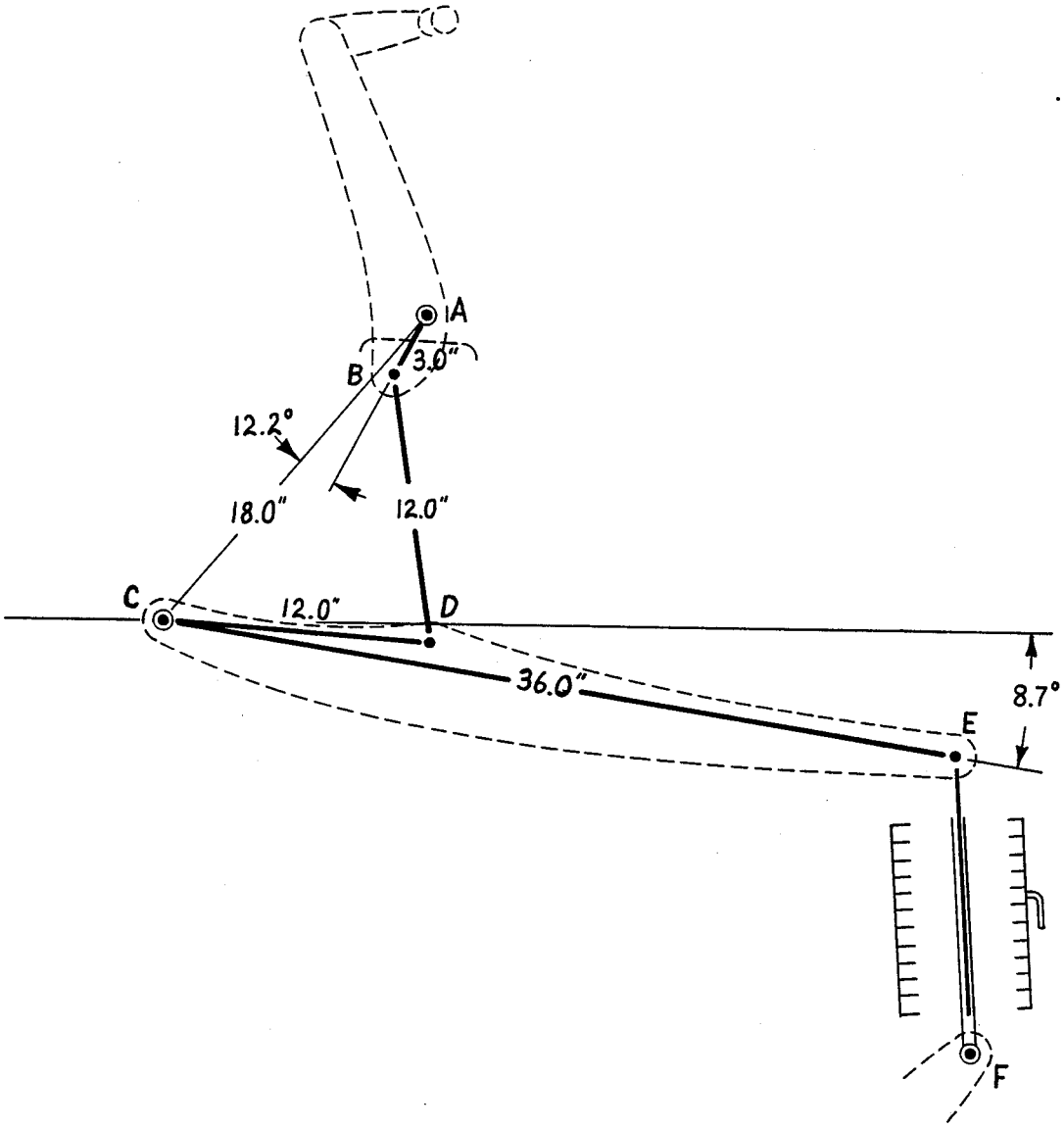
FIG. 3 is a kinematic view of the moving parts of the disclosed arm extension machine taken perpendicular to the plane in which they move, showing all critical dimensions and angles at the starting position of the exercise movement.

Centered about the machine's plane of symmetry is a rotating effort arm assembly (assembly 2.0) which rotates about an axis (axis A) which is both parallel with the ground plane and positioned to be approximately common with the axes through the operator's elbow joints while in the operating position. This rotating effort arm assembly is pivotally mounted to the machine's frame by a steel shaft which is centered on axis A in frame-attached flanges (parts 1.6) which are joined to the top side of part 1.4 in a position between the operator's elbow joints while in the operating position. It is composed of two parallel irregularly shaped flat steel plates (parts 2.1) which join between two parallel bearing tubes (parts 2.2 and 2.3); one of which mounts bearings which engage the steel shaft which mounts the assembly to the machine's frame at axis A (part 2.2) and the second of which mounts bearings which engage a steel shaft which pivotally mounts a rocking handlebar assembly (part 2.4) which contains a pair of right and left handgrips (parts $\mathbf{6.3}_R$ and $\mathbf{6.3}_L$) which the operator's corresponding right and left hands engage while performing the exercise. Parallel with and offset by 3.0" from axis A are a pair of colinear holes lying in parts 2.1 at axis B which journal a steel shaft which is used in connecting a connecting link from the rotating effort arm assembly (assembly 2.0) to the rotating weight arm assembly (assembly 3.0). As shown in FIG. 3, the direction from axis A to axis B is along a line which forms a 12.2° angle with the line connecting axis A with axis C at the beginning of the exercise movement.

As shown in FIGS. 1 and 2, the invention contains a rotating weight arm assembly (assembly 3.0) which rotates about an axis (axis C) which is both parallel with and offset by 18.0" from the axis of rotation of the rotating effort arm assembly (axis A). Like the rotating effort arm assembly, the rotating weight arm assembly is pivotally mounted to the machine's frame by a steel shaft which is centered on axis C in bearings which are mounted in a bearing tube (part 1.7) which is joined to the machine's frame through part 1.1 as shown. It is composed of two parallel irregularly shaped flat steel plates (parts 3.1) which are symmetrical about the machine's plane of symmetry and share two parallel pairs of colinear holes; one pair of which journal the steel shaft which mounts the assembly to the machine's frame at axis C and the other pair of which journal a second steel shaft which is used in connecting the connecting link mentioned earlier from the rotating effort arm assembly (assembly 2.0) at axis B to the rotating weight arm assembly (assembly 3.0) at axis D. As shown in FIGS. 1 and 2, the pair of colinear holes which lie at axis C are located at the rearward ends of parts 3.1 and the pair of colinear holes which lie at axis D are located in the middles of parts 3.1 at a distance of 12.0" away from and parallel with the pair lying at axis C.

Attached to the forward (distal) ends of parts 3.1 at axis E which is both parallel with and offset from axis C by a distance of 36.0" is a weight applying means which can take either the simple form of a horizontal weight receiving bar (part 3.3) for loading plate weights onto or the more complex form of a selectorized weight stack assembly (assembly 5.0) which is composed of the standard rocking weight supporting rod with spaced apertures (part 5.3) which is pivotally mounted to the rotating weight arm by a steel shaft at axis E and which extends down through a stack of vertically stacked weights (parts 5.1) which are free to move up and down a rocking guide assembly (part 5.2) which is pivotally attached to the front of the machine's frame in frame-attached flanges (parts 1.8) at axis F and which extends up through the stack of vertically stacked weights. As is conventional, a desired quantity of weights can be quickly and easily mechanically joined to part 5.3 by operator manipulation of a weight engaging key pin (part 5.4) which extends through a selected aperture in the stack of weights into a mating aperture in the pivotal weight supporting rod (part 5.3). The angle formed between the line connecting axis E with axis C and the horizontal line passing through axis C is 8.7° below horizontal at the beginning of the exercise movement as shown in FIG. 3.

As shown in FIGS. 1 and 2, the two rotating assemblies on the machine (assemblies 2.0 and 3.0) are mechanically linked to each other by a rigid steel connecting link assembly (assembly 4.0) which is composed of two parallel flat steel bars (parts 4.1) which join at their upper ends into a transverse bearing tube (part 4.2) and at their lower ends into a second transverse bearing tube (part 4.3). The upper end of this connecting link assembly connects to the rotating effort arm assembly at axis B by way of the steel shaft mentioned earlier which is engaged by bearings mounted in part 4.2. The lower end of this connecting link assembly connects to the rotating weight arm assembly at axis D by way of the steel shaft mentioned earlier which is engaged by bearing mounted in part 4.3. As shown in FIG. 3, the distance between the axes of the bearing tubes 4.2 and 4.3 on this connecting link assembly is 12.0".

Figure 4:
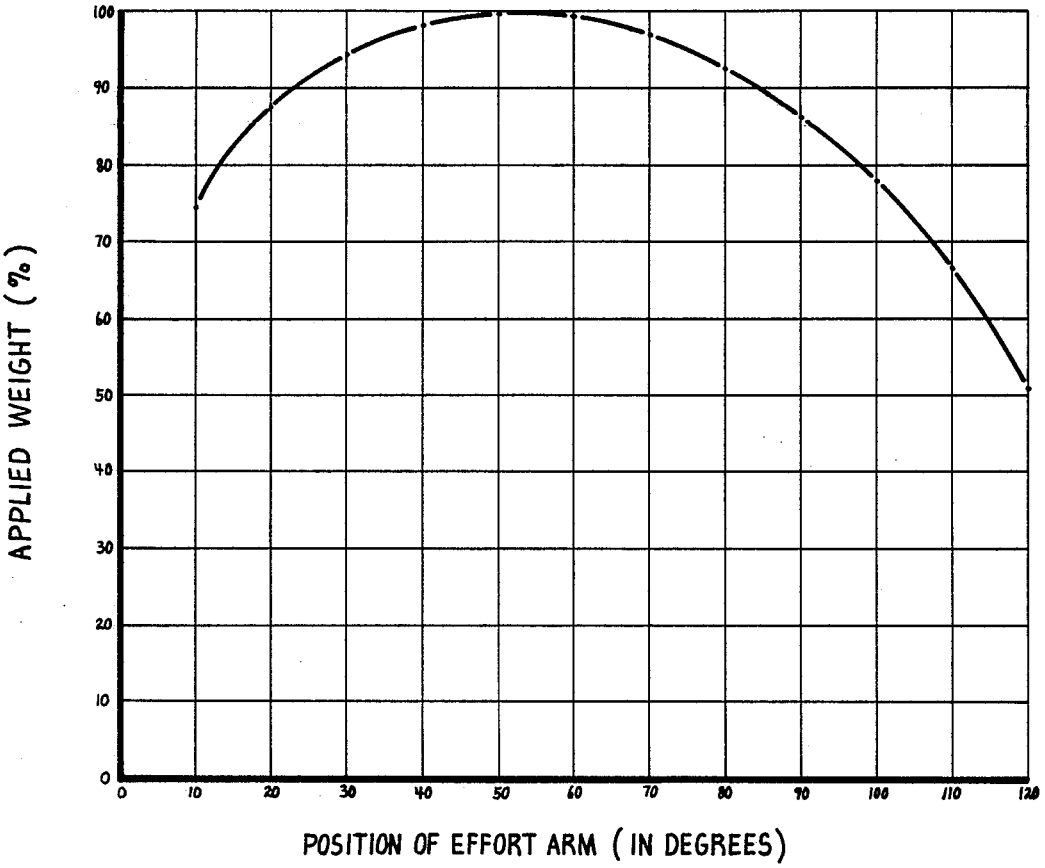
FIG. 4 is a graph generated from kinematic analysis of the force-varying mechanism composed of the moving parts shown in FIG. 3.

When the rotating effort arm assembly (assembly 2.0) is in its starting position and all angles and distances for the force-varying mechanism are as shown in FIG. 3 the corresponding output shown in the graph in FIG. 4 will be obtained while performing the exercise.

HOW THE INVENTION WORKS

As shown in FIGS. 1 and 2, this invention utilizes two rotating bodies which are journaled on parallel axes in a common frame and joined to each other by a rigid connecting body. These two rotating bodies (the rotating effort arm assembly-assembly 2.0 and the rotating weight arm assembly-assembly 3.0), the frame of the machine (assembly 1.0), and the rigid connecting body (the connecting link assembly-assembly 4.0) join to form a simple planar double-rocking-lever four-bar linkage. This four-bar linkage, whose members' lengths and orientations are as described in FIG. 3, when acting in conjunction with the sinusoidally changing values of force applied by the machine's rotating weight arm as the weight applied at axis E swings through a circular path through the gravitational field, applies, to the operator's hands through body-machine contact with the rotating effort arm, the variably resistive force shown in the graph in FIG. 4.

CONCLUSION

This invention applies a variably resistive force to an operator's arm extending muscles throughout the range of a arm extension exercise movement. This variably resistive force is obtained through the use of a kinematically derived and specified four-bar linkage acting in conjunction with a rotating weight arm. This rotating weight arm/four-bar linkage force-varying mechanism consist of only three moving parts connected to each other and to the frame of the machine at a total of four pivotal joints, making the machine inherently more reliable, less noisy, and more friction free than a comparable arm extension machine which uses cams, chains, or cables. In addition, because the machine uses no members that go through any cyclic bending (as is the case with a machine using cables) the problems associated with fatigue wear are eliminated making the machine's moving parts essentially maintenance free.

I claim:

1. An exercise machine which develops an operator's arm extending muscles, comprising:

a rigid frame which includes means for fixing the positions of said operator's upper arms and elbow joints;

a rigid rotating effort arm which is journaled in said frame on a generally horizontal axis which is approximately common with the axes of rotation of said operator's elbow joints while said operator's upper arms and elbow joints are supported by said fixing means;

said rigid rotating effort arm includes hand-engaging surfaces which, through body-machine contact, transmit resistive forces to the operator's forearms through circular paths about the operator's elbow joints;

wherein, in its resting position, said rigid rotating effort arm extends radially from said fixing means, such that when the operator's upper arms and elbow joints are supported by said fixing means resistive force is applied in the direction of arm flexion;

a rigid rotating weight arm which is journaled in said frame on an axis which is both parallel with and separated by a specific distance from the axis of rotation of said rigid rotating effort arm;

said rigid rotating weight arm includes means for loading weights onto at a point offset from its axis of rotation;

said rigid rotating effort arm and said rigid rotating weight arm are mechanically linked to each other at axes which are both parallel with and offset by specific distances from their respective axes of rotation by a rigid connecting link which has a specific length between its centers of connection;

said rigid rotating effort arm, said rigid rotating weight arm, said link mechanically joining said rigid rotating effort arm and said rigid rotating weight arm, and said frame of said arm extension exercise machine join together to form a four-bar linkage which, when acting in conjunction with the sinusoidally changing values of force applied by the machine's rotating weight arm as the applied weight swings through a circular path through the gravitational field, applies a predetermined variably resistive force which varies as a function of the degrees of rotation of the operator's elbow joints and which is characteristic of the relationships in length and orientation of the four rigid members forming the four-bar linkage and the orientation of the rotating weight arm to the gravitational field throughout the range of the exercise movement;

said specific distance between the axis of rotation of said rigid rotating effort arm and the axis of rotation of said rigid rotating weight arm, said specific distance between the axis of rotation of said rigid rotating effort arm and the axis of connection of said connecting link on said rigid rotating effort arm, said specific distance between the axis of rotation of said rigid rotating weight arm and the axis of connection of said connecting link on said rigid rotating weight arm, and said specific distance between the centers of connection on said connecting link all have a definite non-changing relationship to each other, which relationship, along with their orientations to each other, is determined through kinematic analysis of the moving parts of the four-bar linkage/rotating weight arm force-varying mechanism and is dependent on said predetermined variably resistive force which said four-bar linkage/rotating weight arm force-varying mechanism is designed to put out throughout the exercise movement.

2. The exercise machine of claim 1 in which said means for loading weights onto said rotating weight arm at a point offset from its axis of rotation consist of a horizontal weight supporting bar onto which plate weights can be loaded.

3. The exercise machine of claim 1 in which said means for loading weights onto said rotating weight arm at a point offset from its axis of rotation consist of a weight supporting means which is pivotally connected to said rotating weight arm at said point offset from said rotating weight arm's axis of rotation and which extends approximately vertically downward through a plurality of weights which are slideably mounted to a rocking guide assembly which is pivotally mounted to said machine's frame for vertical movement relative to said frame whereby a predetermined number of said weights may be mechanically attached to said weight supporting means for movement therewith.

* * * * *